US008120630B2

(12) United States Patent
Kurosawa

(10) Patent No.: US 8,120,630 B2
(45) Date of Patent: Feb. 21, 2012

(54) IMAGE SHIFT ADJUSTING APPARATUS OF IMAGE FORMING APPARATUS

(75) Inventor: Norio Kurosawa, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 801 days.

(21) Appl. No.: 12/200,741

(22) Filed: Aug. 28, 2008

(65) Prior Publication Data

US 2009/0067893 A1 Mar. 12, 2009

Related U.S. Application Data

(60) Provisional application No. 60/970,474, filed on Sep. 6, 2007.

(51) Int. Cl.
*B41J 2/525* (2006.01)

(52) U.S. Cl. ..... 347/116; 347/234

(58) Field of Classification Search ..... 347/116, 347/234, 233, 248, 249; 399/298, 299, 301
See application file for complete search history.

(56) References Cited

U.S. PATENT DOCUMENTS

| | | | | |
|---|---|---|---|---|
| 5,778,280 | A * | 7/1998 | Komiya et al. | 399/49 |
| 5,854,958 | A * | 12/1998 | Tanimoto et al. | 399/49 |
| 6,317,147 | B1 * | 11/2001 | Tanaka | 347/116 |
| 2006/0120419 | A1 * | 6/2006 | Takahashi et al. | 372/38.01 |
| 2008/0226361 | A1 * | 9/2008 | Tomita et al. | 399/301 |
| 2009/0129416 | A1 * | 5/2009 | Moriyama | 372/38.02 |

FOREIGN PATENT DOCUMENTS

JP P08-278680 A 10/1996

* cited by examiner

*Primary Examiner* — Huan Tran
(74) *Attorney, Agent, or Firm* — Patterson & Sheridan, LLP

(57) ABSTRACT

First patterns for setting a first adjustment value and second patterns for setting a second adjustment value are formed on a transfer belt running at a first process speed. By this, an image shift adjustment value in a sub-scanning direction is made common to the first process speed and a second process speed. Image shift adjustment values in a main scanning direction are set for the first process speed and the second process speed, respectively.

18 Claims, 13 Drawing Sheets

IMAGE SHIFT ADJUSTING APPARATUS OF IMAGE FORMING APPARATUS

CROSS-REFERENCE TO RELATED APPLICATION

This application is based upon and claims the benefit of priority from prior U.S. Provisional Application 60/970,474 filed on Sep. 6, 2007, the entire contents of which are incorporated herein by reference.

TECHNICAL FIELD

The present invention relates to an image shift adjusting apparatus of an image forming apparatus, which adjusts superimposition of plural images for respective color components formed on plural photoreceptors in a color copier or a printer.

BACKGROUND

As an image forming apparatus, a color image forming apparatus is known in which images of respective colors formed on photoreceptors in plural image formation stations are superimposed on a record medium or a transfer belt. In the image forming apparatus as stated above, it is necessary that plural images formed in the plural image formation stations are accurately superimposed on the transfer belt.

Thus, hitherto, in each of the plural image formation stations, an adjustment pattern formed on the transfer belt is detected, and an adjustment value obtained based on the detection result is used to correct an image shift. On the other hand, as an image forming apparatus, there is a color image forming apparatus in which plural process speeds are changed and image formation is performed. In the color image forming apparatus in which the plural process speeds are changed, hitherto, it is necessary that an adjustment value is obtained each time the process speed varies and an image shift is corrected.

However, when the adjustment value is obtained each time the process speed varies and the image shift is corrected, each time the process speed is changed, it takes labor to perform the image shift correction, and it takes time to correct the image shift. Thus, it takes time to shift to another process speed, and there is a fear that improvement in productivity is hindered.

Then, in an image forming apparatus having plural process speeds, it is desirable to develop an image shift adjusting apparatus of the image forming apparatus, which shortens a time required for image shift correction when the process speed is changed and can improve the productivity of images.

SUMMARY

According to an aspect of the invention, one process speed is used, and adjustment values for respective plural process speeds are obtained. By this, an operation required for image shift correction when a process speed is changed is simplified, a time required for the image shift correction is shortened, and the productivity of images is improved.

According to an embodiment of the invention, an image shift adjusting apparatus of an image forming apparatus includes a running member running at a specified speed, plural image forming units configured to form adjustment patterns different in shape on the running member running at a first speed according to frequencies of exposure beams and by using identical pattern data in an adjustment mode, a detection unit configured to detect the adjustment patterns formed on the running member, and a correction unit configured to correct an image shift caused by the plural image forming units based on detection results of the adjustment patterns obtained by the detection unit.

DETAILED DESCRIPTION

Figure 1:
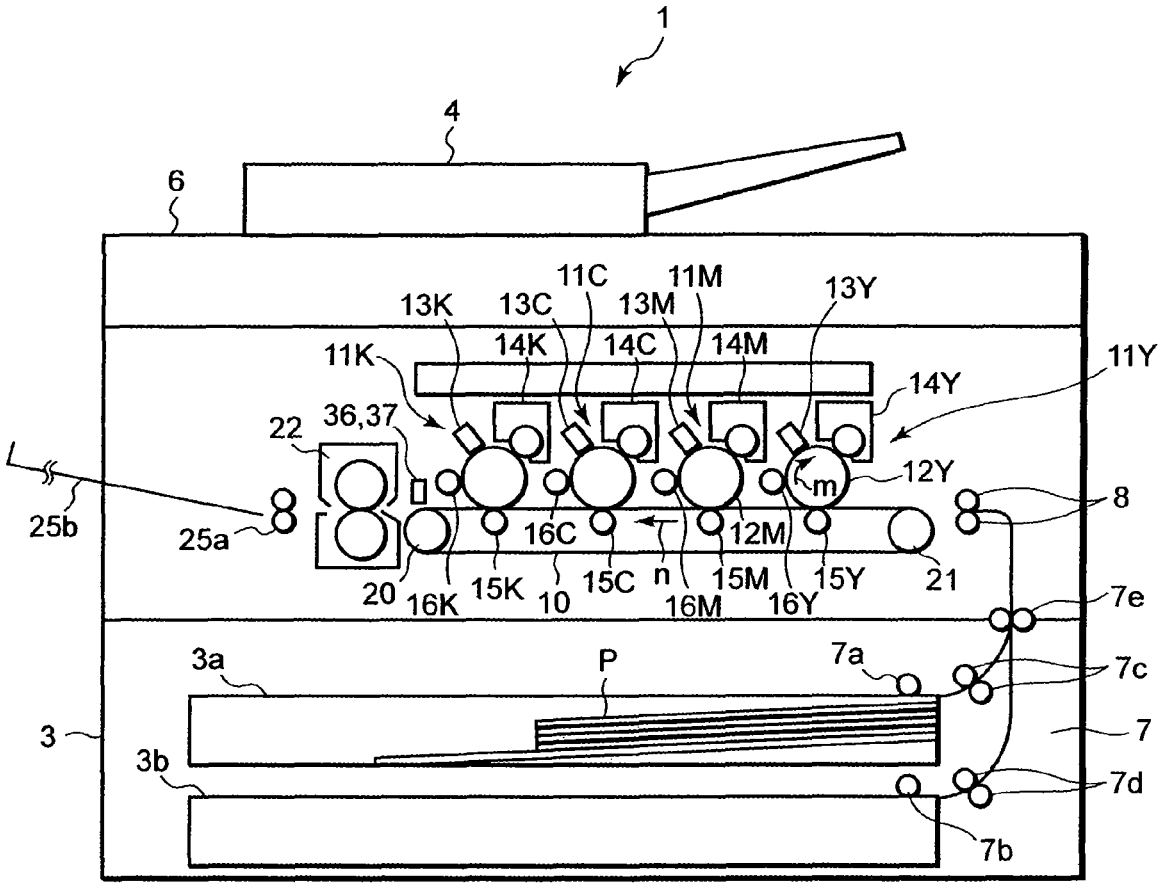
FIG. 1 is a schematic structural view showing a color copier according to a first embodiment of the invention.

Hereinafter, a first embodiment of the invention will be described in detail with reference to the accompanying drawings. FIG. 1 is a schematic structural view showing a four-tandem color copier 1 as an image forming apparatus of an embodiment of the invention. The color copier 1 switches between two process speeds, that is, a first process speed of a first speed and a second process speed of a second speed, and can form an image. Switching of the process speed may be performed by selecting one of the process speeds by, for example, an operation panel 153 or by setting monochromatic image formation or color image formation.

The color copier 1 includes a scanner unit 6, at an upper part, to read an original document supplied by an auto document feeder 4. The color copier 1 includes image formation stations 11Y, 11M, 11C and 11K as four sets of image forming units of yellow (Y), magenta (M), cyan (C) and black (K) arranged in parallel along a transfer belt 10 as a running member.

The respective image formation stations 11Y, 11M, 11C and 11K include photoconductive drums 12Y, 12M, 12C and 12K. The rotating shafts of the photoconductive drums 12Y, 12M, 12C and 12K are parallel to a direction (main scanning direction) orthogonal to a running direction (sub-scanning direction) of an arrow n direction of the transfer belt 10. Further, the respective rotating shafts of the photoconductive drums 12Y, 12M, 12C and 12K are arranged to be separate from each other at equal intervals along the sub-scanning direction.

Charging chargers 13Y, 13M, 13C and 13K, developing devices 14Y, 14M, 14C and 14K, and photoreceptor cleaners 16Y, 16M, 16C and 16K are arranged around the photoconductive drums 12Y, 12M, 12C and 12K along a rotation direction of an arrow m direction respectively. The developing devices 14Y, 14M, 14C and 14K respectively have two-component developers made of toners of yellow (Y) magenta (M), cyan (C) and black (K) different in color and carriers, and supply the toners to electrostatic latent images on the photoconductive drums 12Y, 12M, 12C and 12K. Each of the image formation stations 11Y, 11M, 11C and 11K can form an image at two process speeds.

Exposure lights from a laser exposure device 17 are irradiated between the charging chargers 13Y, 13M, 13C and 13K and the developing devices 14Y, 14M, 14C and 14K around the respective photoconductive drums 12Y, 12M, 12C and 12K, and electrostatic latent images are formed on the photoconductive drums 12Y, 12M, 12C and 12K respectively.

Figure 2A:
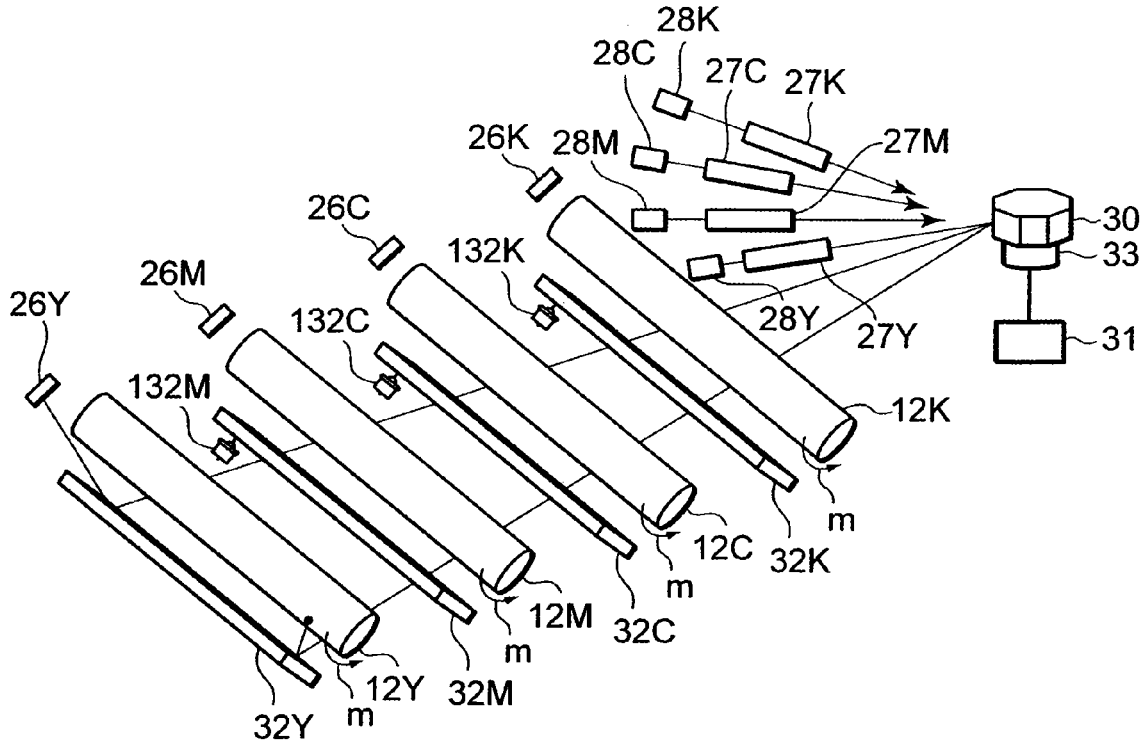
FIG. 2A is a schematic structural view showing a positional relation between a laser exposure device and a photoconductive drum according to the first embodiment of the invention.

As shown in FIG. 2A, the laser exposure device 17 includes laser oscillators 27Y, 27M, 27C and 27K to oscillate laser beams as exposure beams to the photoconductive drums 12Y, 12M, 12C and 12K respectively. The laser oscillators 27Y, 27M, 27C and 27K are controlled by laser drivers 28Y, 28M, 28C and 28K based on data of respective color components of image data read by the scanner unit 6 respectively.

Figure 2B:
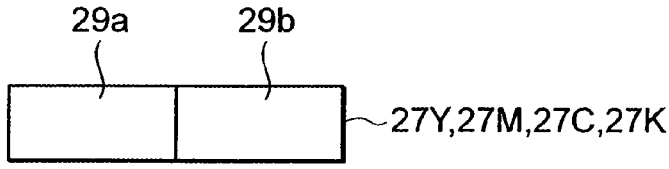
FIG. 2B is a schematic structural view showing a laser oscillator according to the first embodiment of the invention.

As shown in FIG. 2B, each of the laser oscillators 27Y, 27M, 27C and 27K includes a first oscillation unit 29*a* as a first oscillator and a second oscillation unit 29*b* as a second oscillator. The first oscillation unit 29*a* oscillates a first laser beam having a clock frequency of, for example, 100 MHz as a first frequency. The second oscillation unit 29*b* oscillates a second laser beam having a clock frequency of, for example, 125 MHZ as a second frequency. The laser drivers 28Y, 28M, 28C and 28K drive the laser oscillators 27Y, 27M, 27C and 27K respectively. In the case of the first process speed, the laser drivers 28Y, 28M, 28C and 28K drive the laser oscillators 27Y, 27M, 27C and 27K to use the clock of 100 MHz of the first oscillation unit 29*a* respectively. In the case of the second process speed, the laser drivers 28Y, 28M, 28C and 28K drive the laser oscillators 27Y, 27M, 27C and 27K to use the clock of 125 MHz of the second oscillation unit 29*b* respectively.

The laser beams outputted from the laser oscillators 27Y, 27M, 27C and 27K are scanned by a polygon mirror 30 in the main scanning direction. Incident angles of the laser beams to the photoconductive drums 12Y, 12M, 12C and 12K are inclined and adjusted by tilt mirrors 32Y, 32M, 32C and 32K respectively. The respective tilt mirrors 32Y, 32M, 32C and 32K are adjusted so that the rotating shafts of the photoconductive drums 12Y, 12M, 12C and 12K are parallel to the scanning direction of the laser beam. The tilt mirrors 32Y, 32M, 32C and 32K are adjusted based on the yellow (Y) tilt mirror 32Y.

Horizontal synchronization signal detection sensors 26Y, 26M, 26C and 26K are provided on extensions of the photoconductive drums 12Y, 12M, 12C and 12K in the main scanning direction respectively. The horizontal synchronization signal detection sensors 26Y, 26M, 26C and 26K detect the scanning start of the laser beams outputted from the laser oscillators 27Y, 27M, 27C and 27K in the main scanning direction, and output horizontal synchronization signals. The polygon mirror 30 is rotated by a polygon mirror motor 33 driven by a polygon mirror motor driver 31. However there is not necessary to provide a horizontal synchronization signal detection sensor to each laser beam. For example a horizontal synchronization signal detection sensor of yellow is provided as the horizontal synchronization signal detection sensor. In this case a laser beam of yellow (Y) is horizontal synchronized by the horizontal synchronization signal detection sensor of yellow on ahead. After that residual laser beams of magenta (M), cyan (C) and black (K) are horizontal synchronized by leaving a predetermined space from the laser beam of yellow (Y).

The transfer belt 10 is supported by a drive roller 20 and a driven roller 21, and is rotated in the arrow n direction by the driving of the drive roller 20 by a belt motor 10*a*. The running speed of the transfer belt 10 can be changed by the drive roller 20. Toner images formed on the respective photoconductive drums 12Y, 12M, 12C and 12K are transferred to a sheet paper P conveyed in the arrow n direction by the transfer belt 10 at positions of transfer rollers 15Y, 15M, 15C and 15K. By this, a color toner image is formed on the sheet paper P conveyed by the transfer belt 10.

The sheet paper P is fed to the transfer belt 10 through a conveyance path 7 from a cassette mechanism 3 including a first and a second paper feed cassettes 3*a* and 3*b*. The conveyance path 7 includes pickup rollers 7*a* and 7*b* to take out a sheet paper from the paper feed cassettes 3*a* and 3*b*, separation conveyance rollers 7*c* and 7*d*, a conveyance roller 7*e* and a register roller 8. The color toner image is formed on the sheet paper P, and the toner image is fixed by a fixing device 22 to complete the color image, and then, the sheet paper is discharged to a paper discharge tray 25*b* through a paper discharge roller 25*a*.

After the transfer is ended, the remaining toners on the photoconductive drums 12Y, 12M, 12C and 12K are cleaned by the photoreceptor cleaners 16Y, 16M, 16C and 16K, and next printing becomes possible.

Figure 3:
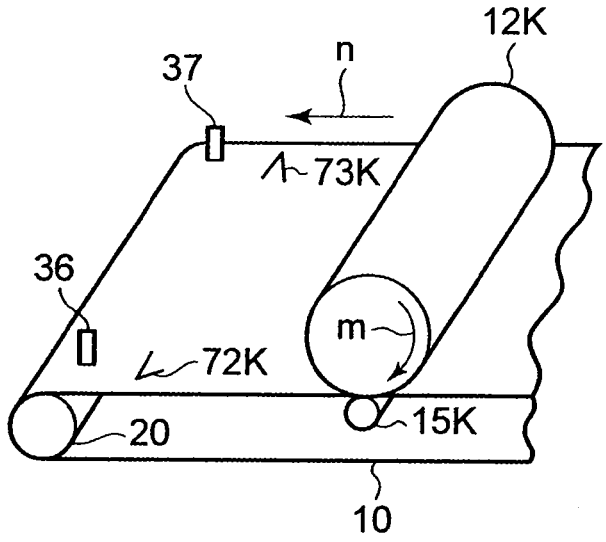
FIG. 3 is a schematic structural view showing a registration sensor according to the first embodiment of the invention.

As shown in FIG. 3, a pair of a first registration sensor 36 and a second registration sensor 37 as a detection unit are arranged downstream of the image formation station 11K of black (K) of the transfer belt 10. The first registration sensor 36 and the second registration sensor 37 are arranged to be separate from each other by a specified distance in the main scanning direction.

Figure 4:
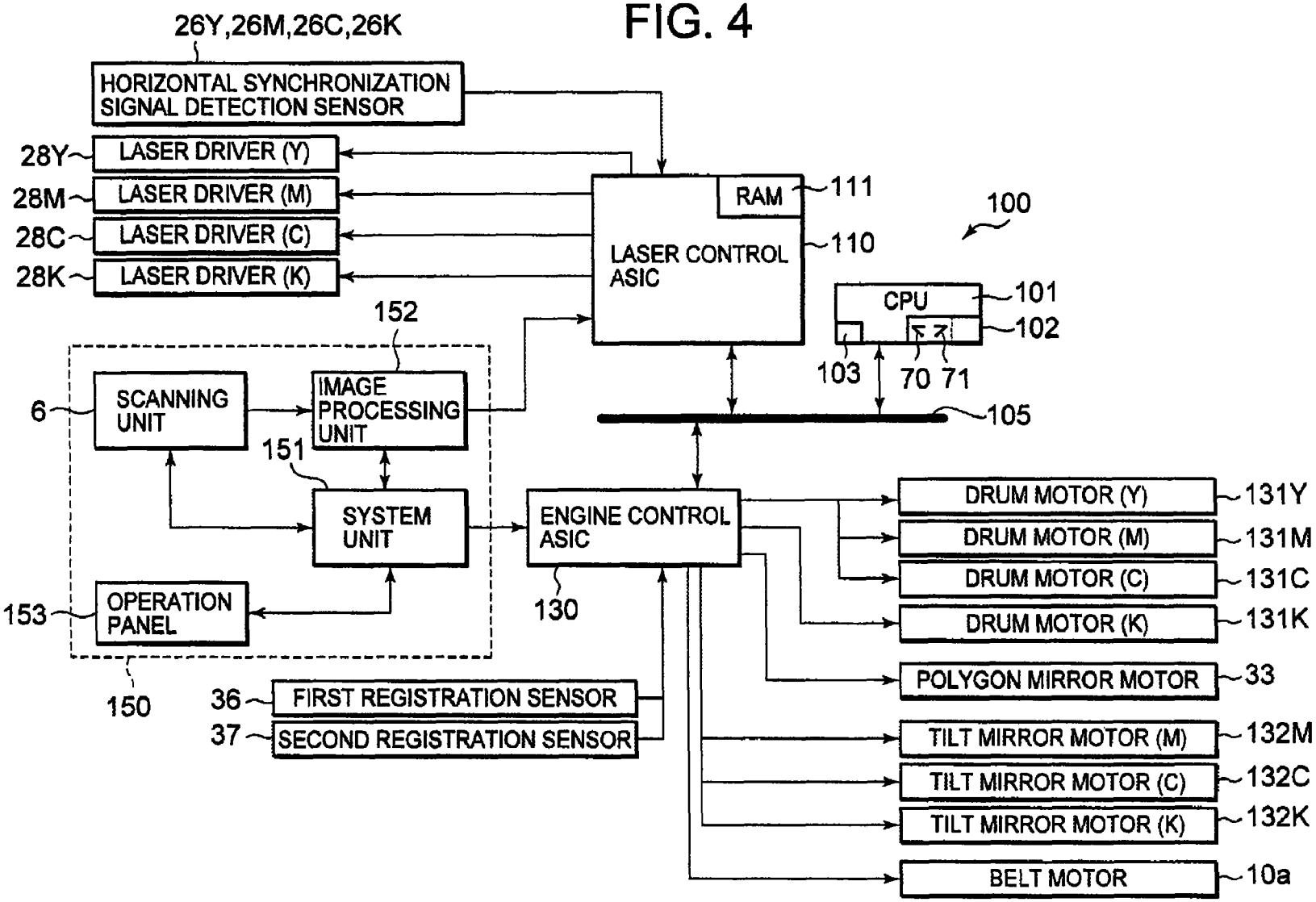
FIG. 4 is a block diagram showing a control system mainly concerned with image shift adjustment according to the first embodiment of the invention.

Next, a registration mechanism to adjust an image shift will be described. FIG. 4 is a block diagram showing a control system 100 mainly concerned with the image shift adjustment. A CPU 101 to control the whole color copier 1 in the control system 100 is connected with a laser control ASIC 110 and an engine control ASIC 130, which are a correction unit, through an input and output interface 105. The CPU 101 includes a memory 102 to store various settings for controlling the laser control ASIC 110 and the engine control ASIC 130, and an arithmetic unit 103 to calculate an adjustment value from a detection result of a pattern for adjusting an image shift formed on the transfer belt 10 by using the laser control ASIC 110.

The laser control ASIC 110 includes a RAM 111 to store various settings for controlling the laser drivers 28Y, 28M, 28C and 28K. Besides, the laser control ASIC 110 is connected with the horizontal synchronization signal detection sensors 26Y, 26M, 26C and 26K.

The engine control ASIC 130 is connected with drum motors 131Y, 131M, 131C and 131K to drive the photoconductive drums 12Y, 12M, 12C and 12K respectively, the polygon motor 33 to drive the polygon mirror 30, the belt motor 10*a* to drive the transfer belt 10, the tilt mirror motors 132M, 132C and 132K to drive the tilt mirrors 32M, 32C and 32K respectively, and the first and the second registration sensors 36 and 37.

Besides, the laser control ASIC 110 and the engine control ASIC 130 are connected with a print control unit 150 for carrying out image formation in the color copier 1. The print control unit 150 includes a system unit 151, an image processing unit 152, the operation panel 153 and the scanner unit 6.

Next, a process of an image shift adjustment at image formation will be described. In the color copier 1, when the process speed is changed, the drive speed of the transfer belt 10, the photoconductive drums 12Y, 12M, 12C and 12K, the developing devices 14Y, 14M, 14C and 14K, and the polygon mirror 30 is changed. However, in each of these, the same motor is used for the first process speed and the second process speed, and the rotation speed of the motor is changed according to the process speed. Accordingly, in the drive system of these, the image shift is adjusted in one of the first process speed and the second process speed, and when the process speed is changed, only the rotation ratio of each motor is changed, and it is unnecessary to again adjust the image shift.

On the other hand, each of the laser oscillators 27Y, 27M, 27C and 27K includes two oscillation units, that is, the first oscillation unit 29*a* and the second oscillation unit 29*b*. When the process speed is changed, the oscillation unit to be used is switched. Since the different oscillation unit is used as stated above, the characteristic of the oscillation unit is changed, and an adjustment value for correcting an image shift varies between the case of the first process speed and the case of the second process speed. Accordingly, the color copier 1 must have an image shift adjustment value at the first process speed and an image shift adjustment value at the second process speed according to the oscillation unit to be used.

Figure 5:
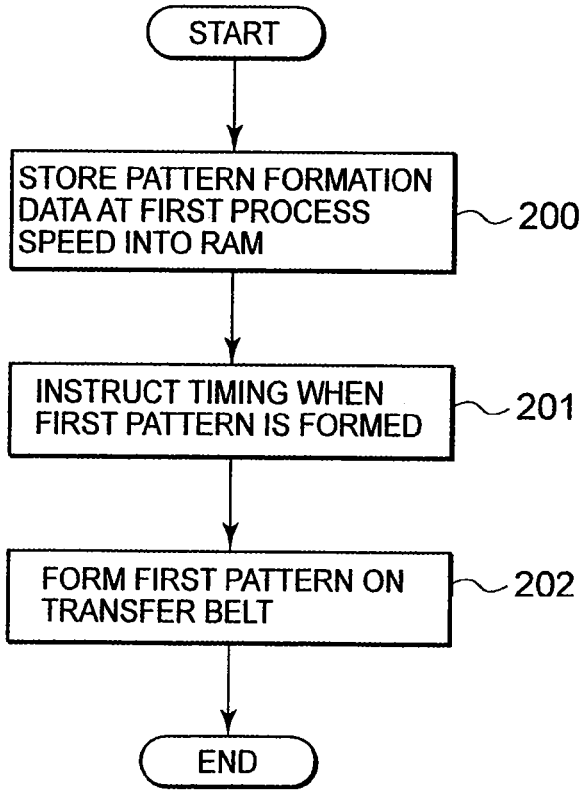
FIG. 5 is a flowchart of forming a first pattern according to the first embodiment of the invention.
Figure 6:
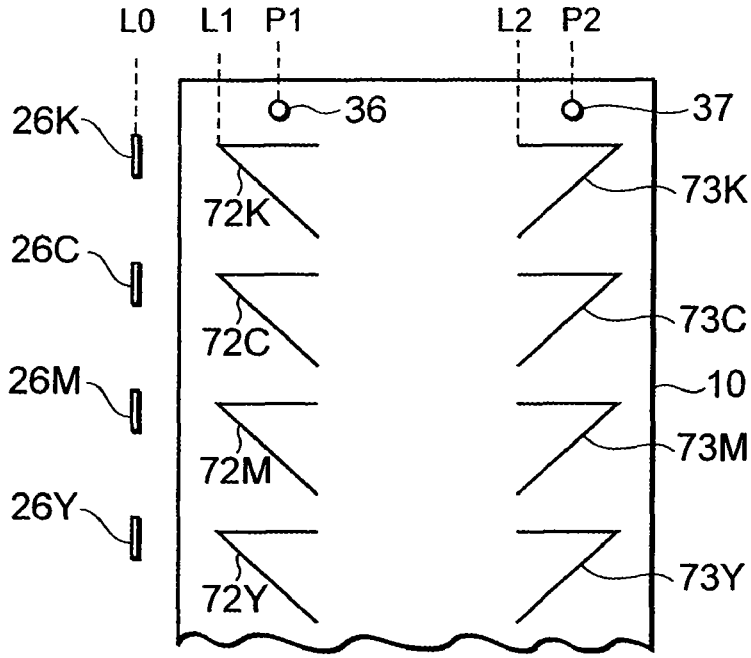
FIG. 6 is a top view of the first pattern according to the first embodiment of the invention.

In order to set two kinds of image shift adjustment values as stated above, first, in accordance with a flowchart of FIG. 5, a description will be given to a formation of a first adjustment pattern on the transfer belt 10. The first adjustment pattern sets the image shift adjustment value at the first process speed. FIG. 6 shows wedge-shaped front side first patterns 72Y, 72M, 72C and 72K and rear side first patterns 73Y, 73M, 73C and 73K, which are the first adjustment pattern.

When the image shift adjustment value at the first process speed is set, it is assumed that the drive speed of the transfer belt 10, the photoconductive drums 12Y, 12M, 12C and 12K, the developing devices 14Y, 14M, 14C and 14K, and the polygon mirror 30 is the first process speed. Besides, each of the laser oscillators 27Y, 27M, 27C and 27K uses the first oscillation unit 29*a* to oscillate the clock frequency of 100 MHz.

At the time of power-on of the color copier 1, at the time of warm-up after a paper jam process, or at the interval of the paper sheets in the image formation process, the color copier 1 is set to an image shift adjustment mode. In the image shift adjustment mode, although paper feed from the cassette mechanism 3 is not performed, the operation other than that is the same as a normal image formation process. Thus, the front side first patterns 72Y, 72M, 72C and 72K and the rear side first patterns 73Y, 73M, 73C and 73K formed on the photoconductive drums 12Y, 12M, 12C and 12K are directly transferred to the transfer belt 10 running at the first process speed.

When the image shift adjustment mode starts, the laser control ASIC 110 reads pattern formation data for forming the front side first patterns 72Y, 72M, 72C and 72K and the rear side first patterns 73Y, 73M, 73C and 73K from the memory 102 of the CPU 101, and stores them in the RAM 111 (Act 200).

As the pattern formation data, there are, for example, a first registration pattern 70 and a second registration pattern 71 which are horizontally symmetrical and are pattern data. Further, as the pattern formation data, there are instructions of writing positions of the first laser beam for forming the front side first patterns 72Y, 72M, 72C and 72K on the transfer belt 10 by the first registration pattern 70, or instructions of writing positions of the second laser beam for forming the rear side first patterns 73Y, 73M, 73C and 73K on the transfer belt 10 by the second registration pattern 71.

The symmetrical first and second registration patterns 70 and 71 have wedge shapes each formed of two crossing straight lines, and have a specified interval. The first and the second registration patterns 70 and 71 come to have pattern shapes shown in FIG. 7A when the pattern formation is performed by the first oscillation units 29*a* of the laser oscillators 27Y, 27M, 27C and 27K at the first process speed and in a width of 0 to 199 counts at 100 MHz. That is, the shape of the generated pattern 70*a*, 71*a* is such that the apex $\alpha$ of the wedge shape is 45°, and the length in the main scanning direction and the length in the sub-scanning direction are 1:1.

Next, in accordance with the pattern formation data read out from the CPU 101, the laser control ASIC 110 instructs the laser drivers 28Y, 28M, 28C and 28K about timings when the front side first patterns 72Y, 72M, 72C and 72K and the rear side first patterns 73Y, 73M, 73C and 73K are formed using the first and the second registration patterns 70 and 71 (Act 201). By this, the front side first patterns 72Y, 72M, 72C and 72K written using the first registration pattern 70 are positioned in the detection range of the first registration sensor 36. The rear side first patterns 73Y, 73M, 73C and 73K written using the second registration pattern 71 are positioned in the detection range of the second registration sensor 37.

For example, in the case of the clock frequency of 100 MHz, it is assumed that the positions of the horizontal synchronization signal detection sensors 26Y, 26M, 26C and 26K are made reference position L0, the first registration sensor 36 is arranged at a position of 150 counts from the reference position L0, and the second registration sensor 37 is arranged at a position of 550 counts from the reference position L0. At this time, the laser control ASIC 110 instructs the laser drivers 28Y, 28M, 28C and 28K about the writing start timings of the first and the second registration patterns 70 and 71 by the laser oscillators 27Y, 27M, 27C and 27K. The timings are the timings when the centers of the front side first patterns 72Y, 72M, 72C and 72K pass the first registration sensor 36, and the centers of the rear side first patterns 73Y, 73M, 73C and 73K pass the second registration sensor 37. Incidentally, in this embodiment, in the case of the clock frequency of 100 MHz, the position of 150 counts from the reference position L0 corresponds to a distance of P1 from the reference position L0. Besides, the position of 550 counts from the reference position L0 is a distance of P2 from the reference position L0.

That is, the laser control ASIC 110 receives horizontal synchronization signals from the horizontal synchronization signal detection sensors 26Y, 26M, 26C and 26K, and then instructs the laser drives 28Y, 28M, 28C and 28K to start pattern formation using the first registration pattern 70 from 100th count as a first clock number. Further, after receiving the horizontal synchronization signals, the laser control ASIC 110 instructs the laser drives 28Y, 28M, 28C and 28K to start pattern formation using the second registration pattern 71 from the 500th count as the second clock number.

By this, on the photoconductive drums 12Y, 12M, 12C and 12K, the formation of electrostatic latent images of the front side first patterns 72Y, 72M, 72C and 72K based on the first registration pattern 70 is started from a position corresponding to a front side first adjustment pattern formation start position L1 shown in FIG. 6. Besides, the formation of electrostatic latent images of the rear side first patterns 73Y, 73M, 73C and 73K based on the second registration pattern 71 is started from a position corresponding to a rear side first adjustment pattern formation start position L2. Thereafter, toner images of the first patterns 72Y, 72M, 72C and 72K and 73Y, 73M, 73C and 73K through the developing devices 14Y, 14M, 14C and 14K are transferred to the transfer belt 10 by the transfer rollers 15Y, 15M, 15C and 15K. By this, the first patterns 72Y, 72M, 72C and 72K and 73Y, 73M, 73C and 73K shown in FIG. 6 are formed on the transfer belt 10 (Act 202).

Figure 8:
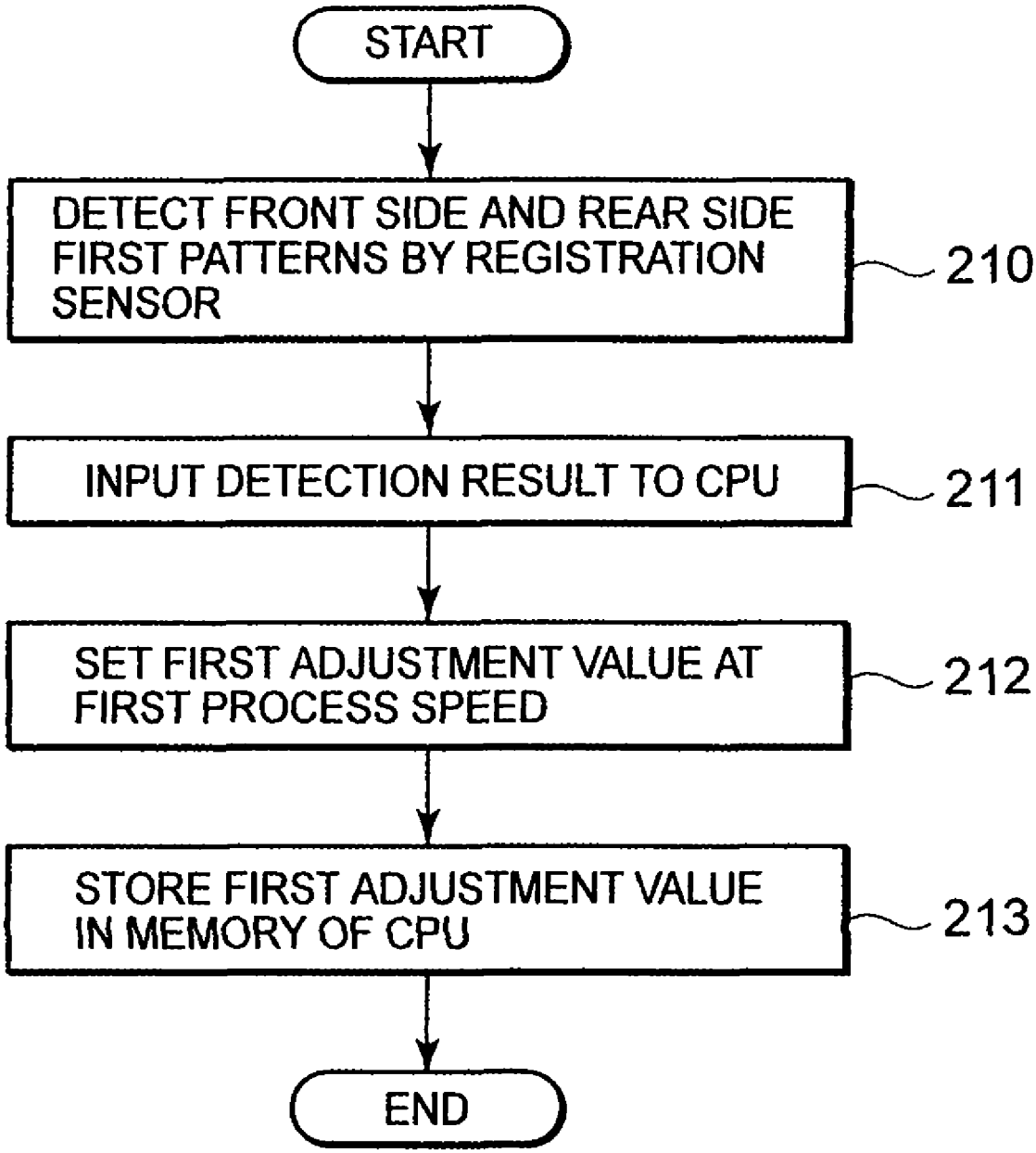
FIG. 8 is a flowchart showing an image shift adjustment using the first pattern according to the first embodiment of the invention.

Next, an image shift adjustment at the first process speed will be described with reference to a flowchart of FIG. 8. By the start of the image shift adjustment, the first registration sensor 36 detects the front side first patterns 72Y, 72M, 72C and 72K formed on the transfer belt 10, and the second registration sensor 37 detects the rear side first patterns 73Y, 73M, 73C and 73K formed on the transfer belt 10 (Act 210).

The detection results are inputted to the CPU 101 through the engine control ASIC 130 (Act 211). The CPU 101 sets a first adjustment value at the first process speed based on the detection results (Act 212). The setting of the first adjustment value is well-known (see, for example, JP-A-8-278680), and various well-known methods can be adopted.

Figure 9:
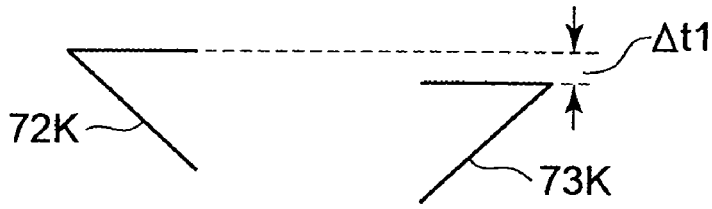
FIG. 9 is an explanatory view of setting an adjustment value of an image inclination from the first pattern according to the first embodiment of the invention.

For example, as shown in FIG. 9, from the detection results of the black (K) front side first pattern 72K and the rear side first pattern 73K formed in the image formation station 11K of black (K), it is assumed that the output start timing is shifted by Δt1 between the front side and the rear side. By this, the CPU 101 determines that the shaft of the black (K) photoconductive drum 12K is inclined with respect to the scanning direction of the laser beam by the laser oscillator 27K. Next, in order to adjust the inclination between both, the CPU 101 sets, as the adjustment value, a rotation amount of the image data corresponding to the inclination amount.

Figure 10:
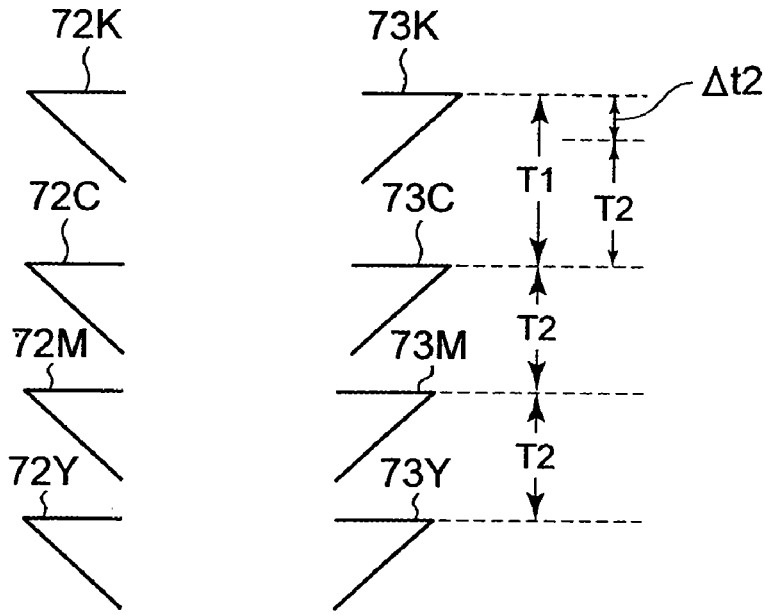
FIG. 10 is an explanatory view of setting an adjustment value of position shift in a sub-scanning direction from the first pattern according to the first embodiment of the invention.

Besides, for example, as shown in FIG. 10, from the detection results of the first and the second registration sensors 36 and 37, it is assumed that an interval T1 between the image formation station 11C of cyan (C) and the image formation station 11K of black (K) in the sub-scanning direction is shifted from an interval T2 between the other image formation stations. The CPU determines that the position of the image formation station 11K of black (K) shifts in the sub-scanning direction by Δt2 which is the difference between the interval T1 and the interval T2. Next, in order to adjust the shift in the sub-scanning direction, the CPU 101 sets, as the adjustment value, an image data output timing corresponding to Δt2. At this time, the adjustment value of the sum of the inclination amount of FIG. 9 and the position shift amount in the sub-scanning direction of FIG. 10 may be set as the image data adjustment value.

Figure 11:
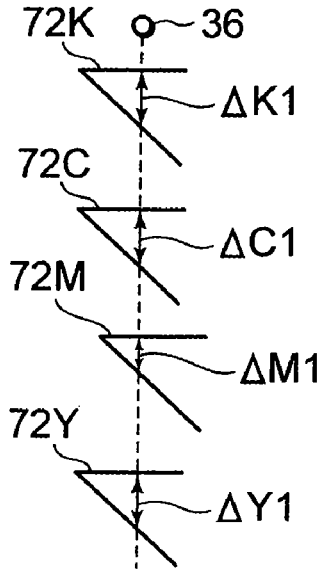
FIG. 11 is an explanatory view of setting an adjustment value of position shift in a main scanning direction from the first pattern according to the first embodiment of the invention.

For example, as shown in FIG. 11, from the detection results of the first and the second registration sensors 36 and 37, it is assumed that the respective image formation stations 11Y, 11M, 11 and 11K cause position shift in the main scanning direction. The CPU 101 determines the position shift of the image in the main scanning direction from differences among detection lengths ΔK1, ΔC1, ΔM1 and ΔY1 of the front side first patterns 72K, 72C, 72M and 72Y. Next, in order to adjust the position shift, the CPU 101 sets, as the adjustment value, the shift amount of image data in the main scanning direction. The adjustment value is set so that ΔK1=ΔC1 ΔM1=ΔY1 is established.

Figure 12:
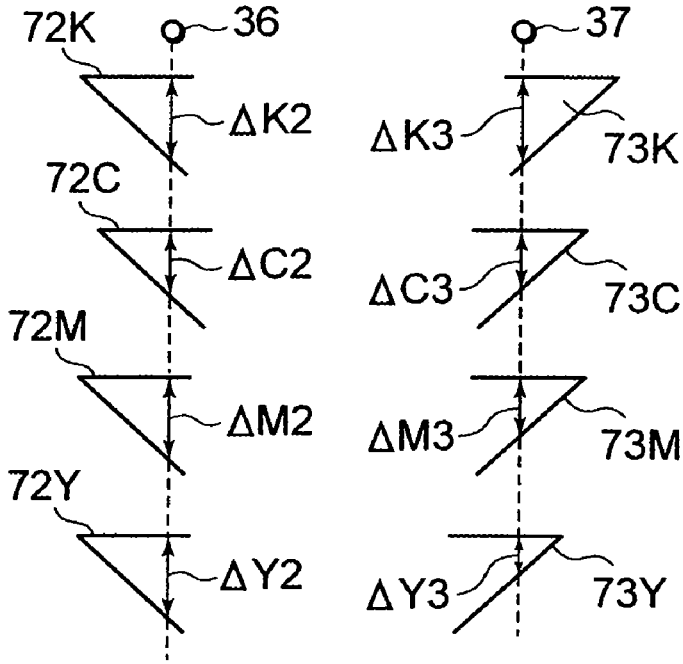
FIG. 12 is an explanatory view of setting an adjustment value of magnification error in the main scanning direction from the first pattern according to the first embodiment of the invention.

Further, for example, as shown in FIG. 12, from the detection results of the first and the second registration sensors 36 and 37, it is assumed that the respective image formation stations 11Y, 11M, 11C and 11K cause magnification errors in the main scanning direction. The CPU 101 determines the magnification error in the main scanning direction from detection lengths of the front side first patterns 72K, 72C, 72M and 72Y and the rear side first patterns 73K, 73C, 73M and 73Y.

For example, the detection lengths of the front side first patterns 72K, 72C, 72M and 72Y are made ΔK2, ΔC2, ΔM2 and ΔY2, and the detection lengths of the rear side first patterns 73K, 73C, 73M and 73Y are made ΔK3, ΔC3, ΔM3 and ΔY3. The adjustment value is set from the value of the sum of the front side detection length and the rear side detection length for each color. That is, when (ΔK2+ΔK3)=(ΔC2+ΔC3)=(ΔM2+ΔM3)=(ΔY2+ΔY3) is established, it is determined that the image magnifications in the main scanning direction of the respective image formation stations 11K, 11C, 11M and 11Y are the same. Accordingly, the CPU 101 sets, as the adjustment value, the expanded amount or contracted amount of the image data so that the shift amount of the image magnification in the main scanning direction is eliminated.

In this embodiment, for example, (ΔK2+ΔK3)=(ΔC2+ΔC3)=(ΔM2+ΔM3)=(ΔY2+ΔY3)=1 is made a reference value. When (ΔK2+ΔK3)=(1+R) is established in the black image formation station 11K, this is larger than the reference value by (R). Accordingly, P1×(correction coefficient)+P2×(correction coefficient)=(R) (where, P1 is the distance from the reference position L0 to the first registration sensor 36. P2 is the distance from the reference position L0 to the second registration sensor 37).

Accordingly, (correction coefficient)=(R)/(P1+P2). By using this, the clock frequency is multiplied by (1+correction coefficient) to obtain the adjustment value.

The various adjustment values are calculated by the arithmetic unit 103 of the CPU 101 and are set. First adjustment values including the various adjustment values in the main scanning direction and the sub-scanning direction at the set first process speed are stored in the memory 102 of the CPU 101 (Act 213).

Next, setting of an image shift adjustment value at the second process speed will be described. When the image shift adjustment value at the second process speed is set, it is assumed that the drive speed of the transfer belt 10, the photoconductive drums 12Y, 12M, 12C and 12K, the developing devices 14Y, 14M, 14C and 14K, and the polygon mirror 30 is the first process speed. In each of the laser oscillators 27Y, 27M, 27C and 27K, the second oscillation unit 29*b* to oscillate the clock frequency of 125 MHz is used.

When the image shift adjustment value at the second process speed is set, since the position shift adjustment value in the sub-scanning direction is already set by the setting of the image shift adjustment value at the first process speed, only an image shift adjustment value in the main scanning direction is set.

In order to set the image shift adjustment value at the second process speed, similarly to the setting of the image shift adjustment value at the first process speed, second adjustment patterns corresponding to the first patterns 72Y, 72M, 72C and 72K and 73Y, 73M, 73C and 73K are formed on the transfer belt 10. However, at this time, the second oscillation unit 29*b* is used in each of the laser oscillators 27Y, 27M, 27C and 27K.

Thus, even if the patterns are formed on the transfer belt 10 by using the same first and second registration patterns 70 and 71 and at the same process speed, the shapes and formation positions of the second adjustment patterns are different from those of the case where the first oscillation unit 29*a* is used.

Figure 7A:
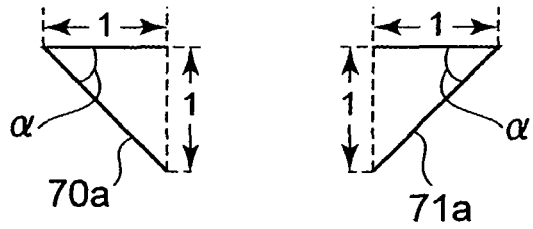
FIG. 7A is a schematic explanatory view showing a shape of a generated pattern formed by a first oscillation unit at a first process speed by using a registration pattern according to the first embodiment of the invention.

Next, a description will be given to differences in the shape of a pattern and the formation position of a pattern between the case where the first oscillation unit 29*a* is used and the case where the second oscillation unit 29*b* is used. First, the difference in the shape of the pattern will be described. Patterns are formed in a width of 0 to 199 counts on the transfer belt 10 running at the first process speed by using the first and the second registration patterns 70 and 71 and by using the first oscillation unit 29*a* to oscillate 100 MHz. By this, as shown in FIG. 7A, the shape of each of the first and the second generated patterns 70*a* and 71*a* is such that the apex $\alpha$ is 45°, and the length in the main scanning direction and the length in the sub-scanning direction are 1:1.

Figure 7B:
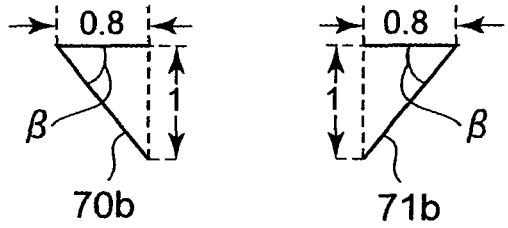
FIG. 7B is a schematic explanatory view showing a shape of a comparison pattern formed by a second oscillation unit at a first process speed by using the registration pattern according to the first embodiment of the invention.

On the other hand, patterns are formed in a width of 0 to 199 counts on the transfer belt running at the first process speed by using the same first and the second registration patterns 70 and 71 and by using the second oscillator 29*b* to oscillate 125 MHz. A first and a second comparison patterns 70*b* and 71*b* formed have pattern shapes shown in FIG. 7B. That is, the shape of each of the comparison patterns 70*b* and 71*b* is such that an apex $\beta$ of a wedge shape is about 51°, and the length in the main scanning direction is contracted to 0.8 with respect to the length of 1 in the sub-scanning direction. As stated above, the first and the second generated patterns 70*a* and 71*a* formed by using the first oscillation unit 29*a* are different from the first and the second comparison patterns 70*b* and 71*b* formed by using the second oscillation unit 29*b* in the angle of the apex and the length in the main scanning direction.

Figure 13:
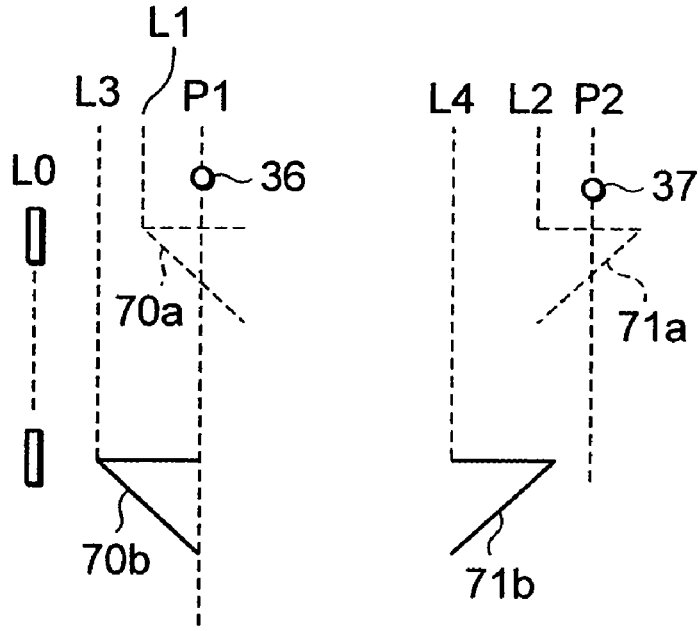
FIG. 13 is an explanatory view showing formation positions of patterns of a case where a first oscillation unit is used and a case where a second oscillation unit is used according to the first embodiment of the invention.

Next, a difference in pattern formation position between the case where the first oscillation unit 29*a* is used, and the case where the second oscillation unit 29*b* is used will be described with reference to FIG. 13. The pattern formation on the transfer belt 10 running at the first process speed is started at the 100th count from the reference position L0 by using the first oscillation unit 29*a* of the clock frequency of 100 MHz and by using the first registration pattern 70, and the pattern formation is started at the 500th count by using the second registration pattern 71. At this time, as indicated by dotted lines in FIG. 13, the formation start position of the first generated pattern 70*a* formed on the transfer belt 10 is a distance of L1 from the reference position L0. The formation start position of the second generated pattern 71*a* is a distance of L2 from the reference position L0.

On the other hand, the second oscillation unit 29*b* of the clock frequency of 125 MHz is used, the formation of the first registration pattern 70 is started at the 100th count from the reference position L0, and the formation of the second registration pattern 71 is started at the 500th count. At this time, as shown by solid lines in FIG. 13, the formation start position of the first comparison pattern 70*b* formed on the transfer belt 10 is a distance of L3 from the reference position L0. The formation start position of the second comparison pattern 71*b* is a distance of L4 from the reference position L0 (where, L3=0.8×L1, L4=0.8×L2).

Thus, when the first and the second registration sensors 36 and 37 are arranged to be opposite to the centers (the distance of P1 from the reference position L0, and the distance of P2 from the reference position L0) of the formation positions of the first and the second generated patterns 70*a* and 71*a* formed on the transfer belt 10, there is a fear that the first or the second comparison pattern 70*b* or 71*b* goes out of the detection range of the first or the second registration sensor 36 or 37. In this embodiment, the formation positions of the second adjustment patterns for setting the image shift adjustment value at the second process speed are corrected. By the correction, the second adjustment patterns are formed in the detection ranges of the first and the second registration sensors 36 and 37.

Figure 14:
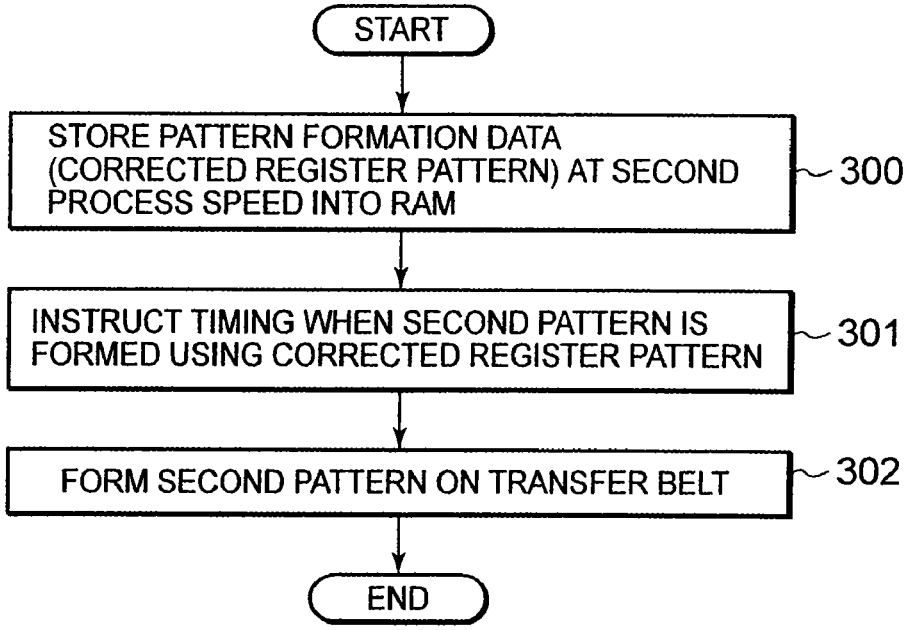
FIG. 14 is a flowchart showing an image shift adjustment using a second pattern according to the first embodiment of the invention.
Figure 15:
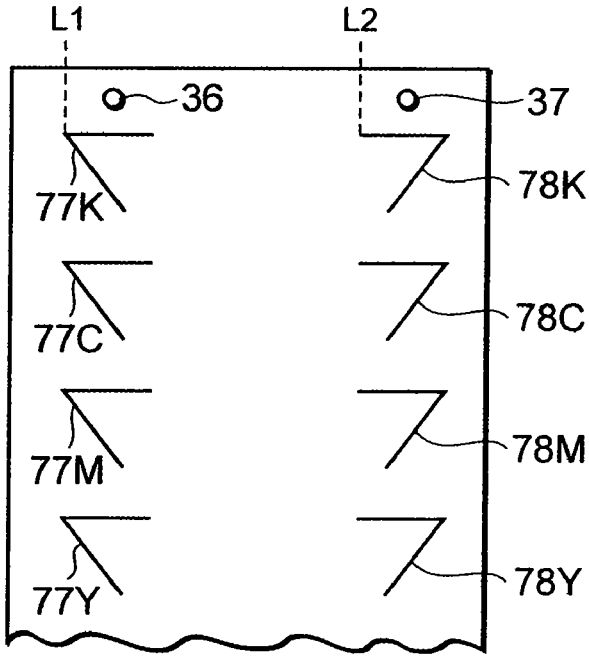
FIG. 15 is a top view of the second pattern according to the first embodiment of the invention.

Next, the formation of the second adjustment patterns on the transfer belt 10 running at the first process speed will be described with reference to a flowchart of FIG. 14. As shown in FIG. 15, the second adjustment patterns include front side second patterns 77Y, 77M, 77C and 77K and rear side second patterns 78Y, 78M, 78C and 78K.

When an image shift adjustment mode starts, the laser control ASIC 110 reads pattern formation data for forming the front side and the rear side second patterns 77Y, 77M, 77C and 77K and 78Y, 78M, 78C and 78K from the memory 102 of the CPU 101, and stores them in the RAM 111 (Act 300).

At Act 300, as the pattern formation data, a first and a second corrected registration patterns are read which are obtained by performing image processing of the first and the second registration patterns 70 and 71 stored in the memory 102 of the CPU 101 by using the first adjustment value at the first process speed, and are stored in the RAM 111.

Further, at Act 300, instructions of the adjustment pattern formation start positions of the laser oscillators 27Y, 27M, 27C and 27K for forming the front side second patterns 77Y, 77M, 77C and 77K and the rear side second patterns 78Y, 78M, 78C and 78K on the transfer belt 10 by using the first and the second corrected registration patterns are read as the pattern formation data, and are stored in the RAM 111. When the clock frequency of the second oscillation unit 29*b* is 125 MHz, the instructions of the adjustment pattern formation start positions of the laser oscillators 27Y, 27M, 27C and 27K are made so that the centers of the front side second patterns 77Y, 77M, 77C and 77K pass the first registration sensor 36, and the centers of the rear side second patterns 78Y, 78M, 78C and 78K pass the second registration sensor 37.

Thus, the timing of the second adjustment pattern formation start of the first registration pattern 70 by the laser oscillators 27Y, 27M, 27C and 27K is shifted to the rear side by {P1−(clock frequency of the first oscillation unit 29*a*/clock frequency of the second oscillation unit 29*b*)×P1} (where, P1 is the distance from the reference position L0 to the first registration sensor 36). Besides, the timing of the second adjustment pattern formation start of the second registration pattern 71 by the laser oscillators 27Y, 27M, 27C and 27K is shifted to the rear side by {P2−(clock frequency of the first oscillation unit 29*a*/clock frequency of the second oscillation unit 29*b*)×P2} (where, P2 is the distance from the reference position L0 to the second registration sensor 37).

In this embodiment, when the second oscillation unit 29*b* is used, the timing of the start of pattern formation using the first corrected registration pattern by the laser oscillators 27Y, 27M, 27C and 27K is shifted to the rear side by (150−0.8×150) counts. That is, after the horizontal synchronization signal is received, the pattern formation using the first corrected registration pattern is started from the 130th count. Besides, the timing of the start of pattern formation using the second corrected registration pattern is shifted to the rear side by (550−0.8×550) counts. That is, after the horizontal synchronization signal is received, the pattern formation using the second corrected registration pattern is started from the 610th count.

By doing so, the front side second adjustment pattern start positions of the front side second patterns 77Y, 77M, 77C and 77K are the position of the distance of L1 from the reference position L0 which is the same as that of the front side first patterns 72Y, 72M, 72C and 72K. Besides, the rear side second adjustment pattern start positions of the rear side second patterns 78Y, 78M, 78C and 78K are the position of the distance of L2 from the reference position L0 which is the same as that of the rear side first patterns 73Y, 73M, 73C and 73K.

Accordingly, at Act 300, the laser control ASIC 110 reads, from the CPU 101, the count numbers as the timings when the formation of the front side second patterns 77Y, 77M, 77C and 77K is started from L1 and the formation of the rear side second patterns 78Y, 78M, 78C and 78K is started from L2, and stores them in the RAM 111. Next, the laser control ASIC 110 instructs the laser drivers 28Y, 28M, 28C and 28K about the timings when the front side second patterns 77Y, 77M, 77C and 77K and the rear side second patterns 78Y, 78M, 78C and 78K are formed by using the corrected registration patterns (Act 301).

By the instructions of the timings, the front side second patterns 77Y, 77M, 77C and 77K formed on the transfer belt 10 are arranged in the detection range of the first registration sensor 36, and the rear side second patterns 78Y, 78M, 78C and 78K are arranged in the detection range of the second registration sensor 37.

That is, on the photoconductive drums 12Y, 12M, 12C and 12K, electrostatic latent images of the front side second patterns 77Y, 77M, 77C and 77K based on the first corrected registration pattern obtained by performing the image processing of the first register pattern 70 are formed from the front side second adjustment pattern formation start position corresponding to L1 shown in FIG. 15. Besides, electrostatic latent images of the rear side second patterns 78Y, 78M, 78C and 78K based on the second corrected registration pattern obtained by performing the image processing of the second registration pattern 71 are formed from the rear side second adjustment pattern formation start position corresponding to L2 shown in FIG. 15.

Thereafter, the toner images of the front side and the rear side second patterns 77Y, 77M, 77C and 77K and 78Y, 78M, 78C and 78K through the developing devices 14Y, 14M, 14C and 14K are transferred to the transfer belt 10 by the transfer rollers 15Y, 15M, 15C and 15K. By this, the front side second patterns 77Y, 77M, 77C and 77K and the rear side second patterns 78Y, 78M, 78C and 78K shown in FIG. 15 are formed on the transfer belt 10 (Act 302).

Figure 16:
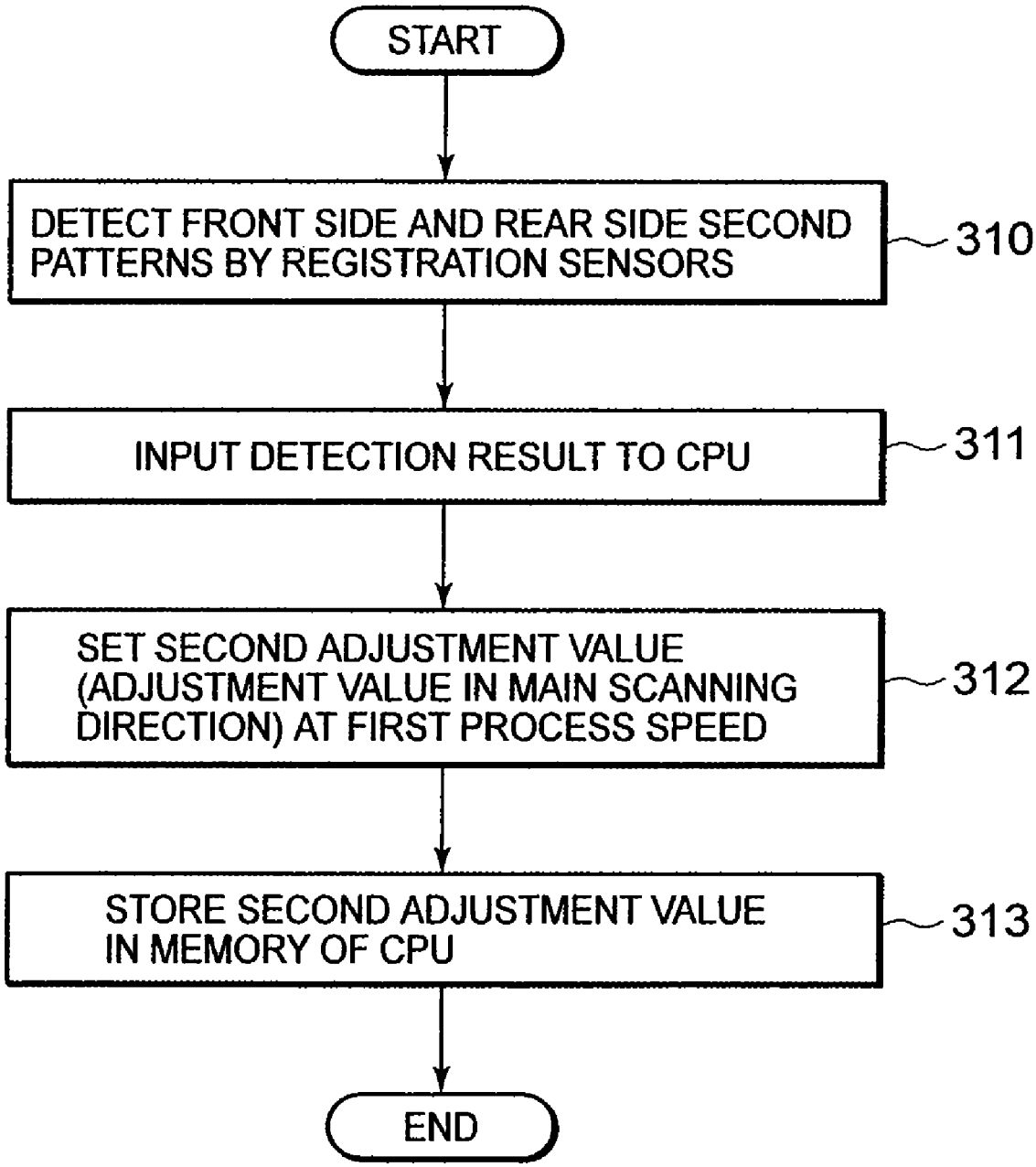
FIG. 16 is a flowchart showing an image shift adjustment using the second pattern according to the first embodiment of the invention.

Next, image shift adjustment at the second process speed will be described with reference to a flowchart of FIG. 16. When the image shift adjustment starts, the front side second patterns 77Y, 77M, 77C and 77K formed on the transfer belt 10 are detected by the first registration sensor 36, and the rear side second patterns 78Y, 78M, 78C and 78K are detected by the second registration sensor 37 (Act 310).

The detection results are inputted to the CPU 101 through the engine control ASIC 130 (Act 311). The CPU 101 sets second adjustment values at the second process speed based on the detection results (Act 312). The second adjustment values include an adjustment value for adjusting an image shift in the main scanning direction and an adjustment value for adjusting a magnification error in the main scanning direction. The adjustment values in the main scanning direction are set similarly to the setting of the first adjustment values.

Figure 17:
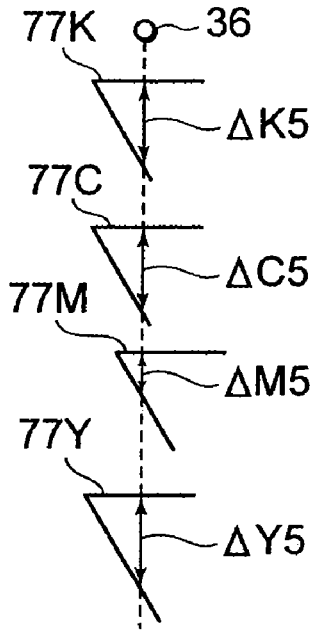
FIG. 17 is an explanatory view of setting an adjustment value of position shift in the main scanning direction from the second pattern according to the first embodiment of the invention.

For example, as shown in FIG. 17, from the detection results of the first and the second registration sensors 36 and 37, it is assumed that position shifts in the main scanning direction occur in the respective image formation stations 11Y, 11M, 11C and 11K. The CPU 101 determines the position shift of an image in the main scanning direction from differences among detection lengths ΔK5, ΔC5, ΔM5 and ΔY5 of the front side second patterns 77K, 77C, 77M and 77Y. Next, in order to adjust the position shift, the CPU 101 sets, as an adjustment value, a shift amount of image data in the main scanning direction according to the shift amount of the image in the main scanning direction. The adjustment value is set so that ΔK5=ΔC5=ΔM5=ΔY5 is established.

Figure 18:
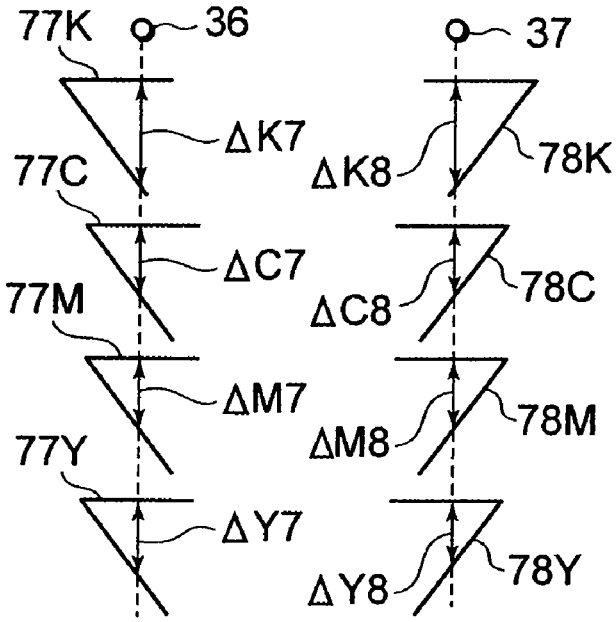
FIG. 18 is an explanatory view of setting an adjustment value of magnification error in the main scanning direction from the second pattern according to the first embodiment of the invention.

Next, for example, as shown in FIG. 18, from the detection results of the first and the second registration sensors 36 and 37, it is assumed that the magnification error in the main scanning direction occur in the respective image formation stations 11Y, 11M, 11C and 11K. The CPU 101 determines the magnification error in the main scanning direction from the detection lengths of the front side second patterns 77K, 77C, 77M and 77Y and the rear side second patterns 78K, 78C, 78M and 78Y.

For example, the detection lengths of the front side second patterns 77K, 77C, 77M and 77Y are made ΔK7, ΔC7, ΔM7 and ΔY7, and the detection lengths of the rear side second patterns 78K, 78C, 78M and 78Y are made ΔK8, ΔC8, ΔM8 and ΔY8. The adjustment value is set from the value of the sum of the front side detection length and the rear side detection length for each color. That is, the CPU 101 sets, as the adjustment value, the expanded amount or contracted amount of image data so that (ΔK7+ΔK8)=(ΔC7+ΔC8)=(ΔM7+ΔM8)=(ΔY7+ΔY8) is established.

In this embodiment, for example, (ΔK7+ΔK8)=(ΔC7+ΔC8)=(ΔM7+ΔM8)=(ΔY7+ΔY8)=1 is made a reference value. On the other hand, in the black image formation station 11K, when (ΔK7+ΔK8)=(1+V) is established, this is larger than the reference value of 1 by (V). However, this is based on the detection in the print result when the pattern is shifted, P1×(H1/H2) is used as P1 in the calculation. Besides, P2×(H1/H2) is used as P2 (where, P1 is the distance from the reference position L0 to the first registration sensor 36, P2 is the distance from the reference position L0 to the second registration sensor 37, H1 is the clock frequency of the first oscillation unit 29*a*, and H2 is the clock frequency of the second oscillation unit 29*b*).

Accordingly, in this case, $$(\text{correction coefficient})=(V)/(P1\times(H1/H2)+P2\times(H1/H2))=(V)/(P1+P2)\times(H1/H2).$$

By using this, the clock frequency is multiplied by {1+(correction coefficient)} to obtain the adjustment value.

The adjustment value of the image shift in the main scanning direction and the adjustment value of the magnification error, at the second process speed, which are caused by using the second oscillation unit 29*b*, are calculated by the arithmetic unit 103 of the CPU 101 and are set. The set second adjustment values including the adjustment values in the main scanning direction at the second process speed are stored in the memory 102 of the CPU 101 (Act 313).

By this, the memory 102 of the CPU 101 stores the first adjustment values for the image shift adjustment in the main scanning direction and the sub-scanning direction at the first process speed, and the second adjustment values for the adjustment of the position shift and the magnification error in the main scanning direction at the second process speed. Thereafter, the color copier 1 completes the image shift adjustment mode and is put in a print mode. In the print mode, for example, the first process speed is set with priority.

Figure 19:
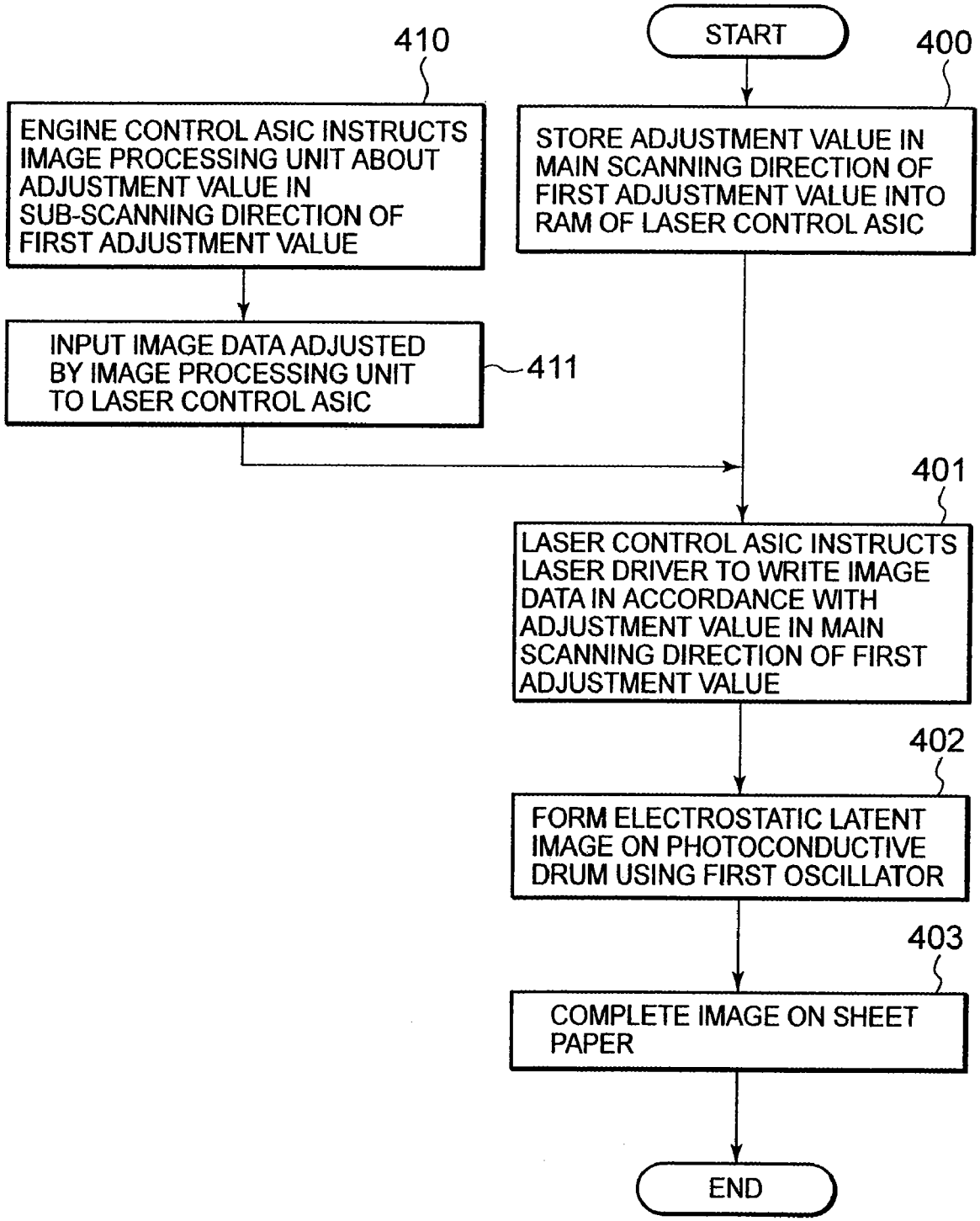
FIG. 19 is a flowchart showing an image formation process at a first process speed according to the first embodiment of the invention.

Next, an image formation process by a first print mode, which is a first image formation mode, at the first process speed will be described with reference to a flowchart of FIG. 19. The image formation process by the first print mode is performed using the first oscillation unit 29*a* to oscillate the clock frequency of 100 MHz of the laser oscillators 27Y, 27M, 27C and 27K. When the image formation process at the first process speed is started, the laser control ASIC 110 reads the adjustment values for adjusting the position shift in the main scanning direction and the magnification error, which are caused by the use of the first oscillation unit 29*a*, from the first adjustment values stored in the memory 102 of the CPU 101, and stores them in the RAM 111 (Act 400).

On the other hand, the engine control ASIC 130 reads the adjustment values in the sub-scanning direction, such as the inclination amount and the rotation amount, from the first adjustment values stored in the memory 102 of the CPU 101, and instructs the image processing unit 152 (Act 410). By this, the image data inputted from the scanner unit 6 is adjusted in the sub-scanning direction by the image processing unit 152, and is inputted to the laser control ASIC 110 (Act 411). The laser control ASIC 110 instructs the laser drivers 28Y, 28M, 28C and 28K to control writing of the image data from the image processing unit 152 in accordance with the adjustment values in the main scanning direction of the first adjustment values (Act 401). By this, the laser oscillators 27Y, 27M, 27C and 27K oscillate the laser beams from the first oscillation units 29*a* at the controlled timings, and form the electrostatic latent images corresponding to the image data on the photoconductive drums 12Y, 12M, 12C and 12K (Act 402). Thereafter, the image formation on the sheet paper P at the first process speed is completed through the developing process, the transfer process, and the fixing process (Act 403), and the image formation process is ended.

Next, a description will be given to a case where an image formation process is performed at the second process speed in the color copier 1. The image formation process at the second process speed is performed using the second oscillation unit 29*b* to oscillate the clock frequency of 125 MHz of the laser oscillators 27Y, 27M, 27C and 27K. When the color copier 1 is set in the first print mode, the mode is switched to a second print mode at the second process speed, which is a second image formation mode, by, for example, the operation panel 153. By this, the laser control ASIC 110 and the engine control ASIC 130 read the second adjustment values from the memory 102 of the CPU 101 similarly to the first process speed.

The adjustment value in the sub-scanning direction in the image shift adjustment at the image formation of the second process speed is identical to that at the first process speed. Accordingly, with respect to the adjustment value in the sub-scanning direction, it is not necessary to again instruct the image processing unit 152. Similarly to Act 411, the image processing unit 152 processes the image data inputted from the scanner unit 6 by the adjustment value such as the inclination amount or the rotation amount in the sub-scanning direction indicated by the first adjustment value, and inputs it to the laser control ASIC 110. However, when the process speed is changed, the engine control ASIC 130 reads the second process speed from the CPU 101, and controls to change the drive speed of the drum motors 131Y, 131M, 131C and 131K, the polygon mirror motor 33, and the belt motor 10*a* to the second process speed.

On the other hand, similarly to Act 400, the laser control ASIC 110 reads the adjustment values for adjusting the position shift in the main scanning direction and the magnification error, which are the second adjustment values stored in the memory 102 of the CPU 101, and stores them in the RAM 111. Next, similarly to Act 401, the laser control ASIC 110 instructs the laser drivers 28Y, 28M, 28C and 28K to control writing of the image data from the image processing unit 152 in accordance with the second adjustment values. By this, similarly to Act 402, the laser oscillators 27Y, 27M, 27C and 27K oscillate laser beams from the second oscillation units 29*b* at the controlled timings, and form electrostatic latent images corresponding to the image data on the photoconductive drums 12Y, 12M, 12C and 12K. Thereafter, similarly to Act 403, the image formation on the sheet paper P at the second process speed is completed through the developing process, the transfer process and the fixing process, and the image formation process is ended.

Thereafter, when the image formation process is again performed at the first process speed, the print mode is switched to the first print mode by the operation panel 153. At this time, with respect to the adjustment value in the sub-scanning direction, it is unnecessary to again instruct the image processing unit 152. However, when the print mode is switched, the engine control ASIC 130 reads the first process speed from the CPU 101, and controls to change the drive speed of the drum motors 131Y, 131M, 131C and 131K, the polygon mirror motor 33, and the belt motor 10*a* to the first process speed.

The RAM 111 of the laser control ASIC 110 is again rewritten to the adjustment values for adjusting the position shift in the main scanning direction and the magnification error in the first adjustment values. And then, the image data inputted from the image processing unit 152 is written to the photoconductive drums 12Y, 12M, 12C and 12K at the frequency oscillated from the first oscillation unit 29*a*, and electrostatic latent images are formed.

There is a case where an image shift occurs by various factors while the image formation process is being performed at the first process speed or the second process speed. Thus, if necessary, at a specified timing or at warm-up after a maintenance process, the first adjustment values and the second adjustment values are again set. The memory 102 of the CPU 101 is rewritten by the first adjustment values and the second adjustment values which are again set.

According to the first embodiment, the first patterns for setting the image shift adjustment values at the first process speed and the second patterns for setting the image shift adjustment values at the second process speed are formed on the transfer belt 10 running at the first process speed. That is, irrespective of the switching of the process speed, the image shift adjustment values in the sub-scanning direction at the first process speed and the second process speed are the same. Accordingly, in the first process speed and the second process speed, the image shift adjustment value in the sub-scanning direction is made common to both, and the image shift adjustment value in the main scanning direction is set for the respective speeds.

As a result, in the adjustment mode, when the image shift adjustment values at the second process speed are set, the setting operation is simplified, and the capacity of the memory to store the set values is reduced. Besides, in the print mode, when the process speed is changed, it is unnecessary to perform the image shift adjustment in the sub-scanning direction, and only the image shift adjustment in the main scanning direction is performed. Accordingly, the adjustment operation at the switching of the process speed can be simplified, and the image formation can be speeded up.

Besides, as in the first embodiment, the formation positions of the first patterns and the second patterns on the transfer belt 10 for setting the image shift adjustment values are aligned, so that the first patterns and the second patterns can be detected by the same registration sensors 36 and 37.

Next, a second embodiment of the invention will be described. The second embodiment is different from the first embodiment in formation positions of second adjustment patterns. Besides, detection units for detecting the second adjustment patterns are provided. Since the others are the same as the first embodiment, the same structure as the structure explained in the first embodiment is denoted by the same reference numeral and its detailed explanation will be omitted.

In the second embodiment, when the second adjustment patterns for setting second adjustment values are formed on the transfer belt 10 running at the first process speed, the count number of the write timing by the second oscillation unit 29*b* of the laser oscillators 27Y, 27M, 27C and 27K is made equal to the count number of the write timing by the first oscillation unit 29*a* at the first process speed.

That is, pattern formation is started at the 100th count from reference position L0 by using a first corrected registration pattern and pattern formation is started at the 500th count by using a second registration pattern 71, by the second oscillation unit 29*b*. Then, the second adjustment patterns are formed on the transfer belt 10. By this, the second adjustment patterns are formed at a distance of L3 from the reference position L0 and a distance of L4 from the reference position L0, which are the formation positions of the first and the second comparison patterns 70*b* and 71*b* explained in FIG. 13. Thus, the second adjustment patterns go out of the detection range of the first or the second registration sensor 36 or 37.

Figure 20:
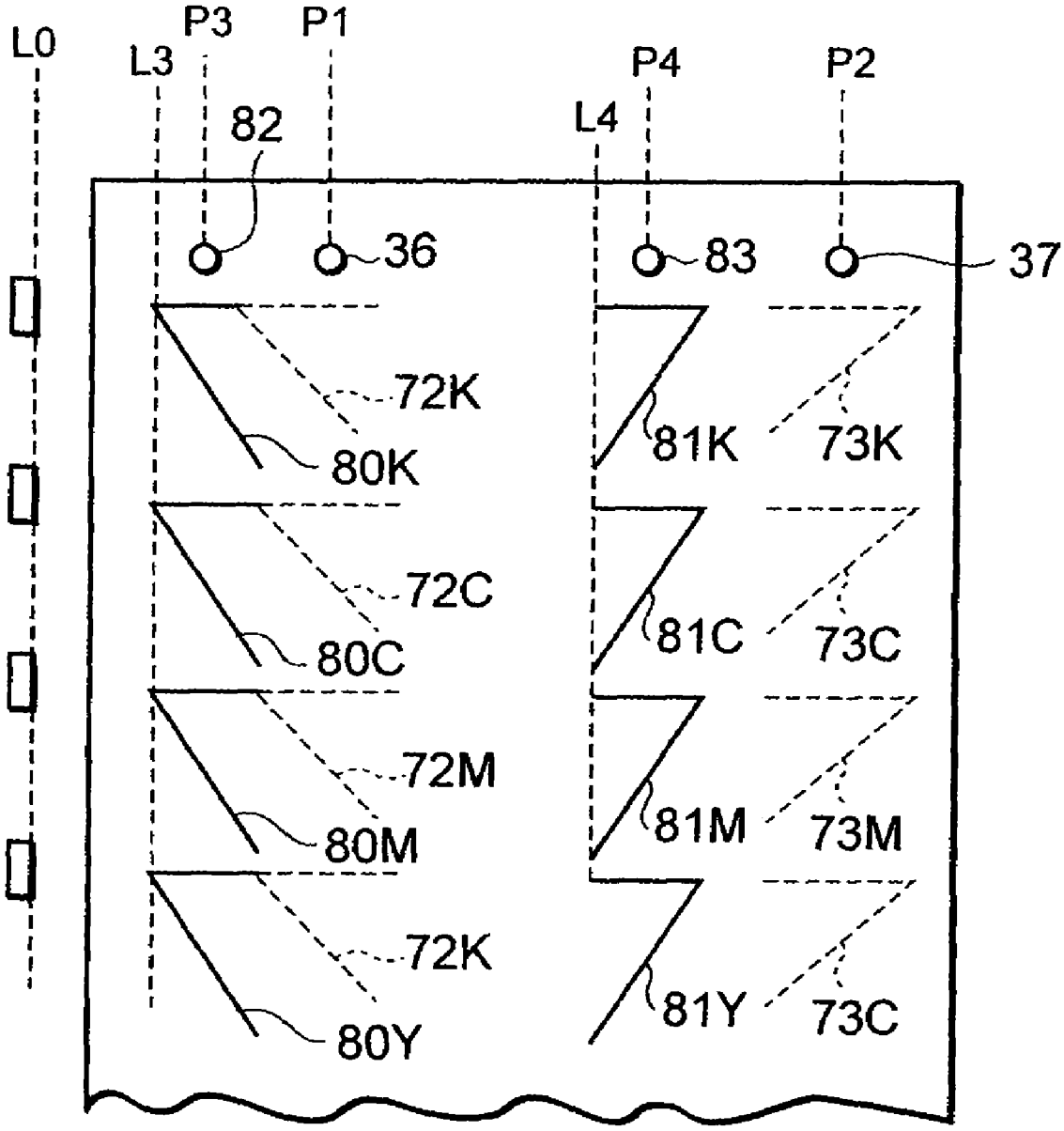
FIG. 20 is an explanatory view showing a third pattern and positions of registration sensors according to a second embodiment of the invention.

Then, in this embodiment, as shown in FIG. 20, a third registration sensor 82 and a fourth registration sensor 83 are disposed in addition to the first and the second registration sensors 36 and 37. The third registration sensor 82 is at a distance of P3 from the reference position L0, and detects front side third patterns 80Y, 80M, 80C and 80K which are the second adjustment patterns formed from the pattern formation start position of L3 from the reference position L0. The fourth registration sensor 83 is at a distance of P4 from the reference position L0, and detects rear side third patterns 81Y, 81M, 81C and 81K which are the second adjustment patterns formed from the pattern formation start position of L4 from the reference position L0.

Thereafter, based on the detection results of the front side third patterns 80Y, 80M, 80C and 80K detected by the third registration sensor 82 and the rear side third patterns 81Y, 81M, 81C and 81K detected by the fourth registration sensor 83, similarly to the first embodiment, the second adjustment values (an adjustment value for adjusting an image shift in the main scanning direction and an adjustment value for adjusting a magnification error in the main scanning direction) at the second process speed are determined.

According to the second embodiment, similarly to the first embodiment, the first patterns for setting the first adjustment values and the third patterns for setting the second adjustment values are formed on the transfer belt 10 running at the first process speed. That is, irrespective of switching of the process speed, the image shift adjustment values in the sub-scanning direction at the first process speed and the second process speed are equal to each other. Accordingly, in the first process speed and the second process speed, the image shift adjustment value in the sub-scanning direction is made common to both, and the image shift adjustment values in the main scanning direction are respectively set, so that the setting operation is simplified, and the capacity of the memory for storing the set values is reduced. Besides, at switching of the process speed in the print mode, only the image shift adjustment in the main scanning direction is performed. Thus, the adjustment operation at the switching of the process speed can be simplified, and the image formation can be speed up.

The present invention is not limited to the above embodiments, but can be variously modified within the scope of the invention. For example, the running speed of the running member is not limited, and the speed can be changed at multiple stages. Similarly, according to the number of running speed switching stages, plural oscillators can be provided. Besides, the clock frequency of the oscillator is not limited. Further, the shape of the pattern data is not limited as long as the image shift can be detected. For example, when Z-shaped pattern data is used, the detection data of the adjustment pattern by the detection unit is increased, and therefore, the image shift adjustment values with higher accuracy can be obtained.

What is claimed is:

1. An image shift adjusting apparatus of an image forming apparatus, comprising:

a running member running at a specified speed;

a plurality of image forming units configured to form adjustment patterns that are different in shape, on the running member that is running at a first speed according to frequencies of exposure beams and by using identical pattern data in an adjustment mode;

a detection unit configured to detect the adjustment patterns formed on the running member; and a correction unit configured to correct an image shift caused by the plurality of image forming units based on detection results of the adjustment patterns obtained by the detection unit.

2. The apparatus according to claim 1, wherein each of the plurality of image forming units includes a plurality of oscillators to oscillate the exposure beams at different frequencies.

3. The apparatus according to claim 2, wherein each of the plurality of image forming units includes a first oscillator to oscillate a first exposure beam at a first frequency to form a first adjustment pattern, and a second oscillator to oscillate a second exposure beam at a second frequency to form a second adjustment pattern.

4. The apparatus according to claim 1, wherein the pattern data includes a plurality of straight lines crossing each other.

5. The apparatus according to claim 4, wherein the adjustment patterns are different in an angle at which the plurality of straight lines cross each other and in lengths of the plurality of straight lines.

6. The apparatus according to claim 3, wherein the detection unit configured to detect the first adjustment pattern and the detection unit configured to detect the second adjustment pattern are identical to each other.

7. The apparatus according to claim 3, wherein the detection unit configured to detect the first adjustment pattern and the detection unit configured to detect the second adjustment pattern are different from each other.

8. The apparatus according to claim 3, wherein the plurality of image forming units, in an image formation mode, perform image formation using the first exposure beam on the running member running at the first speed and perform image formation using the second exposure beam on the running member running at a second speed.

9. An image shift adjusting apparatus of an image forming apparatus, comprising:

a running member running at a specified speed;

a detection unit disposed to be opposite to the running member;

a plurality of image forming units each of which includes a plurality of oscillators to oscillate the exposure beams at different frequencies, the plurality of image forming units being configured to form adjustment patterns on the running member in a detection range of the detection unit according to frequencies of exposure beams and by using identical pattern data in an adjustment mode; and a correction unit configured to correct an image shift caused by the plurality of image forming units based on detection results of the adjustment patterns obtained by the detection unit.

10. The apparatus according to claim 9, wherein each of the plurality of image forming units includes a first oscillator to oscillate a first exposure beam at a first frequency to form a first adjustment pattern, and a second oscillator to oscillate a second exposure beam at a second frequency to form a second adjustment pattern.

11. The apparatus according to claim 10, wherein a first clock number required before the first exposure beam reaches a formation start position of the first adjustment pattern from a reference position is different from a second clock number required before the second exposure beam reaches a formation start position of the second adjustment pattern from the reference position.

12. The apparatus according to claim 10, wherein the plurality of image forming units, in an image formation mode, perform image formation using the first exposure beam on the running member running at a first speed and perform image formation using the second exposure beam on the running member running at a second speed.

13. An image shift adjusting apparatus of an image forming apparatus, comprising:

a running member running at a specified speed;

a detection unit disposed to be opposite to the running member;

a plurality of image forming units configured to form adjustment patterns that are different in an angle at which a plurality of straight lines cross each other and in lengths of the plurality of straight lines, according to frequencies of exposure beams on the running member in a detection range of the detection unit by using identical pattern data in an adjustment mode; and a correction unit configured to correct an image shift caused by the plurality of image forming units based on detection results of the adjustment patterns obtained by the detection unit.

14. An image shift adjusting method of an image forming apparatus, comprising:

forming, by a plurality of image forming units, first adjustment patterns using pattern data on a running member running at a first speed by a first exposure beam having a first frequency;

detecting the first adjustment patterns;

setting a first adjustment value for correcting an image shift caused by the plurality of image forming units based on detection results of the first adjustment patterns;

forming, by the plurality of image forming units, second adjustment patterns using the pattern data on the running member running at the first speed by a second exposure beam having a second frequency;

detecting the second adjustment patterns;

setting a second adjustment value for correcting the image shift caused by the plurality of image forming units based on detection results of the second adjustment patterns;

adjusting the plurality of image forming units based on the first adjustment value during a first mode of image formation to the running member running at the first speed; and adjusting the plurality of image forming units based on the second adjustment value during a second mode of image formation to the running member running at a second speed.

15. The method according to claim 14, wherein the first adjustment pattern is different from the second adjustment pattern in shape.

16. The method according to claim 15, wherein the pattern data includes a plurality of straight lines crossing each other, and the first adjustment pattern is different from the second adjustment pattern in an angle at which the plurality of straight lines cross each other and in lengths of the plurality of straight lines.

17. The method according to claim 14, wherein the first adjustment patterns and the second adjustment patterns are formed on the running member in a detection range of a same detection unit.

18. The method according to claim 17, wherein a first clock number required before the first exposure beam reaches a formation start position of the first adjustment pattern from a reference position is different from a second clock number required before the second exposure beam reaches a formation start position of the second adjustment pattern from the reference position, and the second clock number is changed according to a ratio of the first frequency and the second frequency.

* * * * *